US005737782A

United States Patent [19]

Matsuura et al.

[11] Patent Number: 5,737,782

[45] Date of Patent: Apr. 14, 1998

[54] SICK OR WOUNDED PATIENT BED HAVING SEPARABLE FRAME AND MOVING/ LIFTING APPARATUS FOR THE SEPARABLE FRAME

[75] Inventors: Takashi Matsuura; Reiko Matsuura, both of Kabushiki Kaisha, Japan

[73] Assignee: Matsura Kenkyujo Kabushiki Kaisha, Tokyo, Japan

[21] Appl. No.: 569,352

[22] Filed: Dec. 8, 1995

[51] Int. Cl.[6] ..... A61G 7/14; A61G 7/00; A61G 7/015

[52] U.S. Cl. ..... 5/86.1; 5/83.1; 5/600

[58] Field of Search ..... 5/81.1 R, 83.1, 5/84.1, 85.1, 86.1, 613, 600

[56] References Cited

U.S. PATENT DOCUMENTS

| | | | |
|---|---|---|---|
| 2,112,702 | 3/1938 | Loibl | 5/613 |
| 3,945,003 | 3/1976 | Matsuura | 5/613 |
| 5,333,334 | 8/1994 | Kassai | 5/85.1 |

FOREIGN PATENT DOCUMENTS

| | | | |
|---|---|---|---|
| 52-41933 | 10/1977 | Japan . | |
| 52-47636 | 12/1977 | Japan . | |
| 1 463 586 | 12/1974 | United Kingdom | 5/613 |

*Primary Examiner*—Alexander Grosz
*Attorney, Agent, or Firm*—Hill, Steadman & Simpson

[57] ABSTRACT

A bed is capable of allowing a patient to go away from the bed, take a bath, or go to a stool of his or her own will. The bed includes a bed frame having a plurality of comb teeth cushions provided with intervals therebetween in the longitudinal direction of the bed, and a separable frame having a plurality of comb teeth cushions in alternate relation to the comb teeth cushions on the bed frame. The separable frame includes a moving/lifting apparatus for moving the separable frame away from the bed frame to a wheelchair stand, a toilet stool, a bathtub, etc., which are installed beforehand away from the bed while the patient is kept rested thereon.

21 Claims, 19 Drawing Sheets

SICK OR WOUNDED PATIENT BED HAVING SEPARABLE FRAME AND MOVING/ LIFTING APPARATUS FOR THE SEPARABLE FRAME

BACKGROUND OF THE INVENTION

The present invention generally relates to a bed for the sick or wounded patient, and more particularly to a sick or wounded patient bed having a separable frame and a moving/lifting apparatus for the separable frame, part of which bed is movable while keeping the sick or wounded patient rested thereon, and can separate from the bed for easy transfer of the sick or wounded patient to any other associated equipment such as a wheelchair bench, a toilet stool or a bathtub which is equipped separately.

Patients have heretofore been transferred from a carriage to a bed or an operating table by nurses or other attendants. An apparatus capable of achieving such a transfer of patents without directly touching the patients is disclosed in Japanese Patent Publication No. 52-41993 (Patent No. 913449).

The apparatus disclosed in the above publication is a patient carriage comprising a carriage which includes a frame body B having a number of bar-shaped cushions extending horizontally parallel to each other with certain intervals therebetween, and a frame body A having bar-shaped cushions in the form of comb teeth parallel to each other with certain intervals therebetween which are supported by support frames assembled in a disassemblable manner, the frame body A being laid on the carriage. The bar-shaped cushions of the frame body A are fitted into respective gaps between the bar-shaped cushions of the frame body B to form a flat bed surface. The frame body A and the frame body B are interconnected by a rotatable arm such that when the arm is rotated, the frame body A is moved away from the frame body upwardly. By further moving the frame body A transversely, a patient can be transferred to another bed or the like.

Another similar apparatus is disclosed in Japanese Patent Publication No. 52-47636 (Patent No. 920511). This apparatus is fundamentally based on the same concept as that disclosed in the above-cited Japanese Patent Publication No. 42-41993. More specifically, the apparatus disclosed in Japanese Patent Publication No. 52-47636 comprises a bed main frame having bar-shaped cushions arranged with certain intervals therebetween and a lift frame having bar-shaped cushions arranged in alternate relation to the bar-shaped cushions of the main frame. The bar-shaped cushions of the lift frame are movable vertically through respective gaps between the bar-shaped cushions of the main frame. The apparatus is used in combination with a stretcher having a number of support members in respective positions corresponding to the bar-shaped cushions of the lift frame. Thus, the apparatus intends to transfer a patient from a stretcher to a bed or vice versa.

The above known inventions disclose for the first time the techniques that different frames have bar-shaped cushions in the form of comb teeth arranged in alternate relation and one of the frames is movable through the other frame. These techniques intend to transfer a patient between a carriage and a bed or an operating table, or to transfer a patient between a bed and a stretcher with the aid of nurses and other persons engaged in medical care for the purposes of surgical operations and the like. However, any apparatus enabling a patient to get up from a lying posture of his or her own will and to move from a bed to a wheelchair, a toilet stool or a bathtub by oneself or with the minimum aid of other persons is not yet proposed as far as the inventors are accessible.

SUMMARY OF THE INVENTION

An object of the present invention is, therefore, to provide an apparatus by which a patient who has difficulties in getting up or walking by oneself can get up, move away from a bed and go around, take a bath or go to the stool by oneself or with the minimum aid of other persons, and which can make daily life of a patient easier and more comfortable, particularly in medical hospitals, such as hospitals.

Another object of the present invention is to provide a bed for the sick or wounded patient which is highly air-permeable, can prevent the patient from suffering bedsores and can be kept clean.

Still another object of the present invention is to provide a bed for the sick or wounded patient which enables a sheet to be exchanged by a new one while the patient remains lying on the bed.

Still another object of the present invention is to provide an apparatus which can prevent bedclothes, such as a quilt, from slipping off or falling down from a bed upon movement of a patient, can easily adjust the position of the quilt or the like, and further can vertically move the quilt or the like.

To achieve the above objects according to the present invention, a bed frame includes a plurality of comb teeth cushions provided with certain intervals therebetween in the longitudinal direction of a bed, and a separable frame having comb teeth cushions each positioned in match with a gap between adjacent twos of the above comb teeth cushions on the bed frame is provided to be movable not only vertically, but also horizontally in the transverse or longitudinal directions of the bed. The bed also includes a support arm for supporting the separable frame and a moving/lifting apparatus to which the support arm is attached. The moving/lifting apparatus can move the support arm vertically and also can move the support arm in the transverse or longitudinal directions of the bed.

In the present invention, outer side members of the separable frame are each divided into front and rear portions at the middle in the longitudinal direction, and the front and rear portions are coupled to each other in a foldable manner about a pivot shaft provided at the divided point so that the front portion can be folded upward about the pivot shaft. The separable frame can be moved away from the bed by the moving/lifting apparatus for transfer to a position above any other associated equipment, such as a wheelchair bench, a toilet stool or a bathtub which is equipped separately.

Further, the bed of the present invention can be used in combination with auxiliary cushions which are movable vertically above the bed. The auxiliary cushions are provided so as to extend in the longitudinal direction near both side ends of the bed, and are moveable vertically by an auxiliary cushion lift with such an arrangement that front and rear ends of the auxiliary cushions are connected to bars movable vertically along poles which are attached to the front and rear ends of the bed so as to extend upwardly therefrom at one side of the bed, and at least one of the bars is operatively coupled to the auxiliary cushion lift. A plurality of grippers are provided along an outer side edge of each of the auxiliary cushions to be slidable in the longitudinal direction, and side edges of bedclothes such as a quilt are held by the grippers, enabling the bedclothes to be moved in the longitudinal and vertical directions.

It is to be noted that throughout the specification "front side, front end or front portion of a bed" means a direction of the head of a patient lying on a bed and "rear side, rear end or rear portion of a bed" means a direction of the feet of the patient lying on the bed and "transverse direction" means a direction horizontally perpendicular to the longitudinal direction. For the moving/lifting apparatus, "rear side or rear portion" means the base side of the support arm and "front side or front portion" means the opposite side.

Additional features and advantages of the present invention are described in, and will be apparent from, the detailed description of the presently preferred embodiments and from the drawings

DETAILED DESCRIPTION OF THE PRESENTLY PREFERRED EMBODIMENTS

Figure 1:
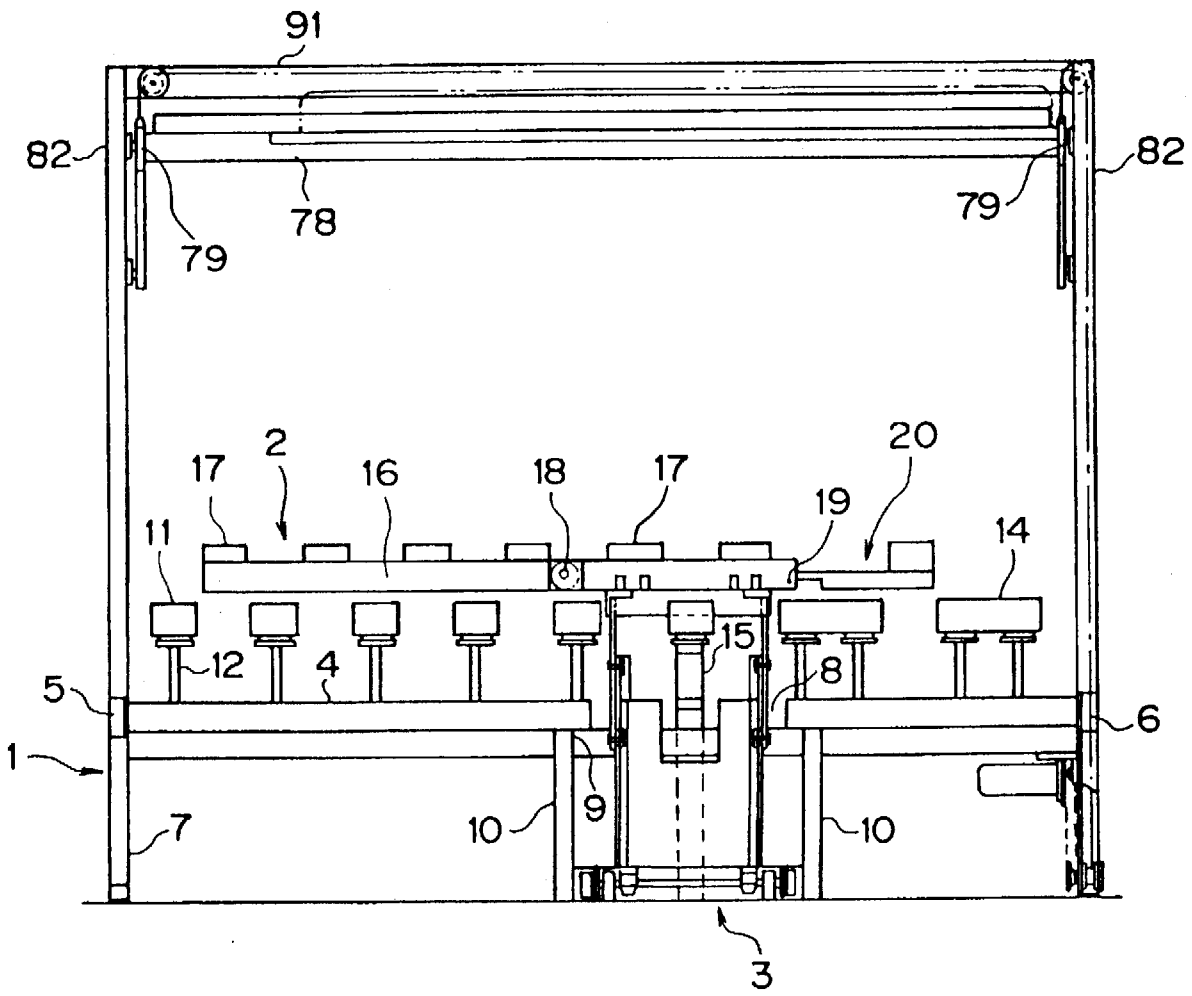
FIG. 1 is a side view of a bed for the sick or wounded patient according to a first embodiment of the present invention in a state that a separable frame is moved upwardly.
Figure 2:
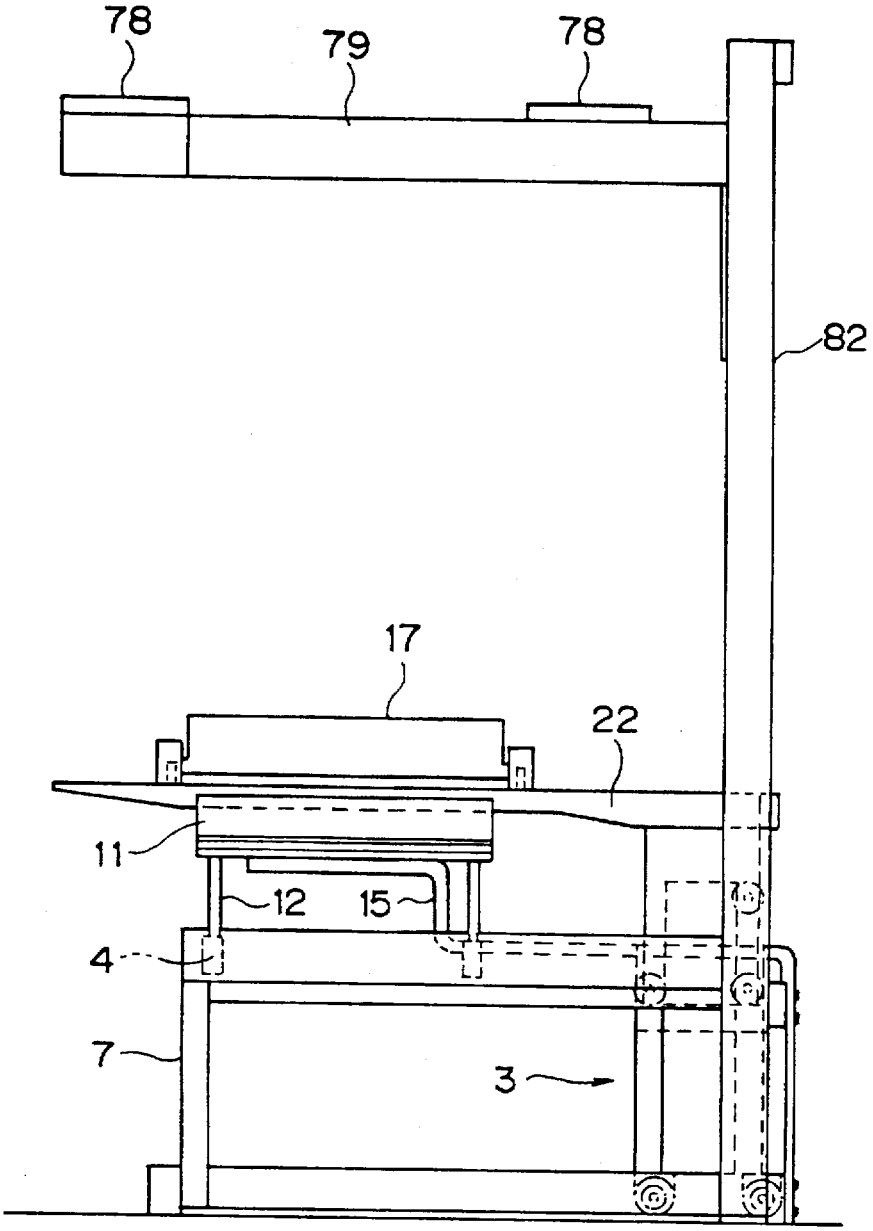
FIG. 2 is a front view of the bed for the sick or wounded patient in the state of FIG. 1.
Figure 3:
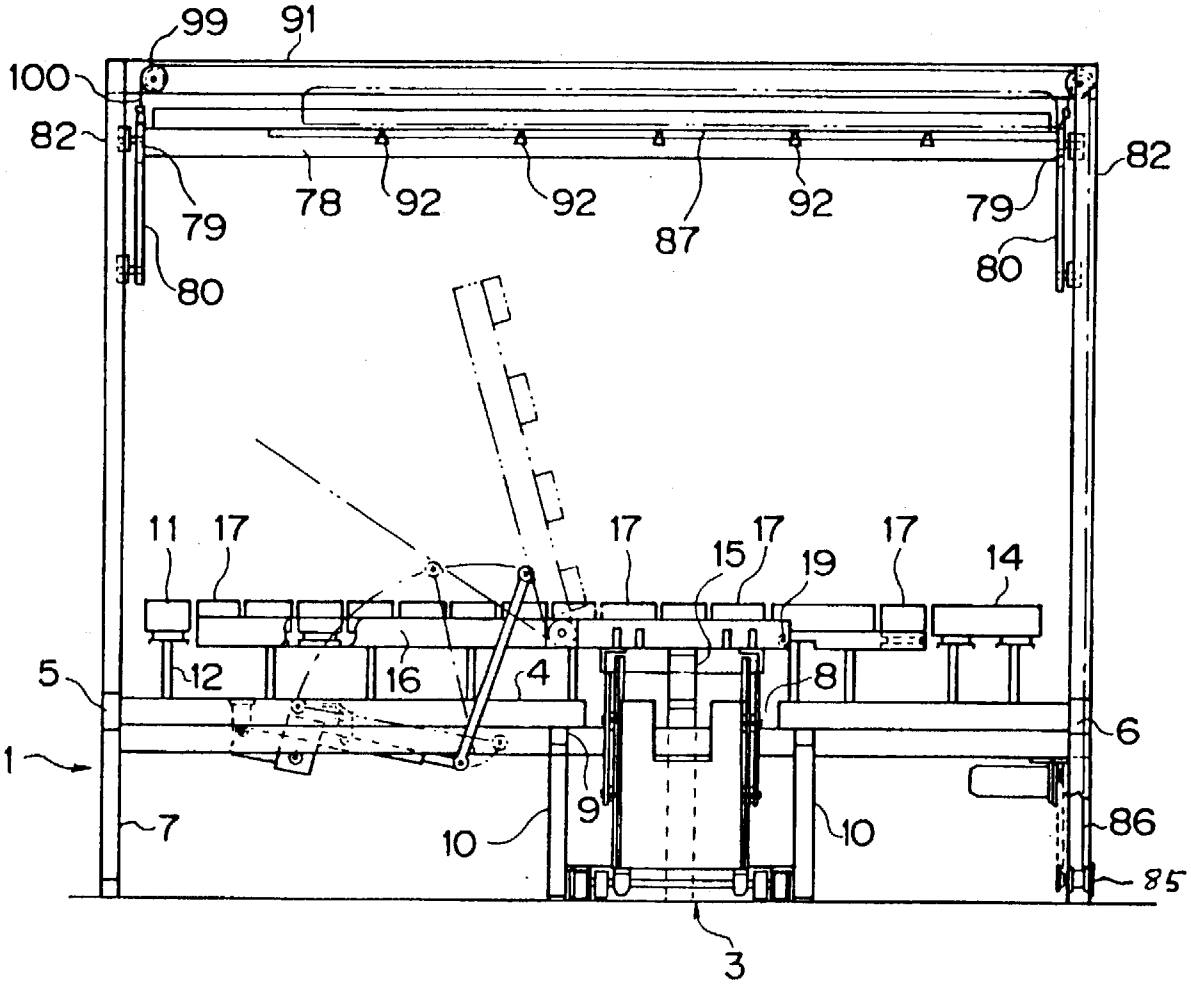
FIG. 3 is a side view of the bed for the sick or wounded patient according to the first embodiment in combination with an auxiliary cushion lift.

As shown in a side view of FIG. 1, a bed for the sick or wounded patient according to the present invention comprises mainly a bed frame 1, a separable frame 2, and a moving/lifting apparatus 3.

In a first embodiment of the bed for the sick or wounded patient according to the present invention shown in FIGS. 1–7, the bed frame 1 includes two horizontal side members 4 extending parallel to each other between front and rear ends of the bed in the longitudinal direction, a horizontal front end member 5 extending at a front end of the bed frame in the transverse direction, a horizontal rear end member 6 extending at a rear end of the bed frame in the transverse direction and legs 7 extending in the vertical direction and supporting the bed frame at its four corners.

At least one of the horizontal side members 4 which is disposed within the bed frame is cut off midway to provide an intermediate cutoff portion 8. At each end of the cutoff portion, the horizontal side member 4 is supported by a beam member 9 extending horizontally in the transverse direction to connect the horizontal side members 4 to each other, and an intermediate post 10 extending vertically to the floor. The intermediate cutoff portion 8 may be provided in each of the two horizontal side members 4. The presence of the intermediate cutoff portion 8 allows the moving/lifting apparatus 3 to move within the bed frame in the transverse direction. The pair of horizontal side members 4 are extended within the bed frame in the longitudinal direction and have front ends fixed to the horizontal front end member 5 and rear ends fixed to the horizontal rear end member 6. A plurality of comb teeth cushions 11, i.e., cushions in the form of square bars extending in the transverse direction are provided on the horizontal side members 4 with certain intervals therebetween in the longitudinal direction such that the cushions are detachably attached to upper ends of respective posts 12 vertically fixed onto the horizontal side members 4. Also, the plurality of comb teeth cushions 11 are provided so as to define the same plane at their upper surfaces.

As a modification of this embodiment, a single horizontal side member 4 may be employed and each of the comb teeth cushions 11 being T-shaped in cross-section may be attached at the center of its lower surface to the upper end of the post 12.

The comb teeth cushions 11 are each formed of a square-bar member and can be manufactured by using a core member made of a hard material, such as iron, surrounding an elastic material, such as foamed plastic, around the core member and covering it with an outer finish material, such as cloth, leather, synthetic leather or a plastic sheet.

The comb teeth cushions, can be attached to the posts 12 on the horizontal side members 4 in any known manner. In this embodiment, hook-shaped metallic parts with openings oriented in the same lateral direction are secured to the tops of the posts 12, and receiving metallic parts adapted to receive the hook-shaped metallic parts are secured to the lower surfaces of the comb teeth cushions 11. The comb teeth cushions 11 can be attached to the posts 12 by engaging the receiving metallic with the hook-shaped metallic parts, and can be released therefrom by pushing the comb teeth cushions 11 attached in place in the direction toward the opening of the hook-shaped metallic parts.

It is convenient for the comb teeth cushions 11 to have the same width from manufacture and handling points of view. But, the comb teeth cushions 11 may have a greater width in part. In this embodiment, a wide comb teeth cushion 14 spreading over two posts adjacent each other in the longitudinal direction is employed in an area close to the patient's feet.

With the presence of the intermediate cutoff portion 8, the interval between the comb teeth cushions 11 provided on the horizontal side members 4 is too large in the intermediate cutoff portion 8. Therefore, a central support frame 15 is provided to support the comb teeth cushion to be located in the intermediate cutoff portion 8. The central support frame 15 has a plate structure bent into the crank form and has a base portion attached to the back side of the bed frame and a free end portion, as opposed to the base portion, for supporting the comb teeth cushion 11 from below.

The separable frame 2 comprises a pair of outer side members 16 extending parallel to the horizontal side members 4 and comb teeth cushions 17 extending transversely between the outer side members 16 and detachably attached to the outer side members 16 with intervals therebetween in the longitudinal direction such that the cushions 17 are positioned and matched with respective gaps between adjacent pairs of the comb teeth cushions 11 attached to the horizontal side members 4. The comb teeth cushions 17 are detachably attached to the separable frame 2 by providing projections at opposite ends of each of the comb teeth cushions 17, one of the projections is connected to a spring disposed inside the cushion and providing recesses in inner surfaces of the outer side members 16 at positions corresponding to the projections so as to receive the projections. When the patient is lying on the bed to rest, the comb teeth cushions 11 on the horizontal side members 4 and the comb teeth cushions 17 attached to the separable frame 2 cooperatively define the same plane at their upper surfaces.

The pair of outer side members 16 of the separable frame 2 are each divided into front and rear portions at the middle in the longitudinal direction. The front and rear portions are coupled to each other by a shaft 18 attached to and extending between the outer side members 16 in the transverse direction such that both of the portions are rotatable about the shaft 18 at the divided point. This arrangement enables the front portion of the separable frame 2 to bend upwardly to provide a backrest for the patient. The separable frame 2 is supported at the rear portion thereof by support arms from below in the vertical direction.

In this embodiment, the rear portions of the outer side members 16 of the separable frame 2 are each divided midway so as to have a rear end portion 20 which is pivotable downwardly about a shaft 19 extending between the outer side members 16 in the transverse direction. This arrangement allows the patient sitting on the separable frame to let down his or her legs. Thus, a backrest portion, a seat portion and a below-the-knee portion can be constituted by bending the outer side members 16 of the separable frame 2. If the rear end portions 20 corresponding to the below-the-knee portion are formed of thin iron plates or pipes pivotally attached to rear ends of the outer side members 16, a larger space can be created around the legs of the patient. Also, if two bar members articulately connected to each other are pivotally attached at opposite ends to the front and rear portions of each of the outer side members 16, an arm rest 21 can be provided on the rear bar member.

The moving/lifting apparatus 3 is provided below the separable frame 2. More specifically, the moving/lifting apparatus 3 in this embodiment is provided midway the bed in the longitudinal direction, i.e., at the position where the intermediate cutoff portion 8 is located in the horizontal side member 4, such that it is movable in the transverse direction of the bed. The moving/lifting apparatus 3 includes a lift frame 23 to which a support arm 22 for supporting the separable frame 2 from below is fixed at its base end portion, and a guide frame 24 for guiding vertical movement of the lift frame 23. The support arm 22 is a bar-like member fixedly attached at its base end portion to an upper end of the lift frame 23 and extending horizontally from the fixed end. In this embodiment, there are disposed two bar-like members, as the support arms 22, extending transversely across the bed parallel to each other with an interval therebetween. The lift frame 23 and the guide frame 24 are provided near one side of the bed, and the two support arms 22 are extended toward the other side of the bed perpendicularly to the outer side members 16 of the separable frame 2 while supporting the outer side members 16 from below.

Each of the support arms 22 has bosses 25 projecting upwardly from its upper surface at the positions where the arm intersects the outer side members 16 of the separable frame 2, and the bosses 25 are received in respective boss receiving holes formed in lower surfaces of the outer side members 16.

Front wheels 26 and rear wheels 27 in pairs are attached to a lower end of the guide frame 24. The wheels are oriented in the transverse direction of the bed, so that the moving/lifting apparatus 3 is movable in the transverse direction of the bed. A guide rail 28 extending in the transverse direction is provided under the bed to guide at least one of the wheels attached to the guide frame. In one embodiment, the pair of rear wheels 27 are positioned outwardly of the pair of front wheels 26 and are guided by one pair of guide rails 28 provided under the bed and extending parallel to each other in the transverse direction.

The guide frame 24 comprises a pair of plate-like members opposed to each other with a space therebetween, extending upward vertically and transversely and fixed to a mount base 29. Front and rear edges of the plate-like members of the guide frame 24 are extended parallel to each other in the vertical direction.

The lift frame 23 comprises a pair of plate-like members opposed to each other with a space therebetween, extending in the transverse direction, and disposed to moved vertically along outer surfaces of the guide frame 24. The base portion of each of the support arms 22 is fixed to the upper end of the lift frame 23. In this embodiment, the support arm 22 is a bar-like metallic member having an L-shape in cross-section, and an inner vertical surface of the metallic member is fixed to an upper outer edge of the lift frame 23. The pair of support arms 22 are attached to a fixed frame 30 extending between the support arms 22 to interconnect them.

A roller 31 is mounted to an inner surface of the lift frame 23 and has an outer peripheral surface engaging a vertical edge of the guide frame 24. In this embodiment, a plurality of rollers 31 are mounted to front and rear portions of the lift frame 23 such that the rollers mounted to the front portion engage front edges of the plate-like members of guide frame 24 and the rollers mounted to the rear portion engage rear edges thereof. In this case, the front rollers on the lift frame 23 are mounted at a relatively low level and the rear rollers on the lift frame 23 are mounted at a relatively high level. Thus, the rollers 31 mounted to the front and rear portions of the lift frame 23 serve as points at which the support arms 22 are supported and guided by the guide frame 24.

The rollers 31 may be grooved rollers each having a groove in its outer peripheral surface. The grooved rollers 31 can be held stably in engagement with the guide frame 24 because of their grooves fitting to the vertical edges of the guide frame 24.

The moving/lifting apparatus 3 includes a wire rope 32. The wire rope 32 has one end secured to a lower portion of the lift frame 23, e.g. a shaft of the roller 31, and the other end connected to a wire rope reel-up drum 33 that is led to pass around a pulley 34 attached to the guide frame 24 at a position higher than the wire rope reel-up drum 33. When a motor 35 as a power source is energized to rotate the wire rope reel-up drum 33, the wire rope 32 is reeled up and out so that the lift frame 23 can move up and down while guided by the guide frame 24. Another motor 36 is mounted to a lower end portion of the guide frame 24 and is operatively coupled to a shaft of the rear wheels 27 for rotating them. As a result, the moving/lifting apparatus 3 can move along the guide rails 28.

A bracket 37 extending in the vertical direction may be attached to the center of the inner surface of the guide frame 24 for reinforcement of the guide frame 24.

In a second embodiment described below in detail with reference to FIGS. 8 to 16, a moving/lifting apparatus 3 movable in the longitudinal direction of the bed is provided under the separable frame 2. The moving/lifting apparatus 3 includes a guide frame 38 movable over the floor in the longitudinal direction, support arms 39 for supporting the separable frame 2, and a lift frame 40 for supporting the support arms 39 in a vertically movable manner.

As with the first embodiment, a bed frame 1 includes a pair of horizontal side members 4 extending parallel to each other between front and rear ends of the bed in the longitudinal direction. A horizontal front end member extends at a front end of the bed frame in the transverse direction, and a horizontal rear end member 6 extends at a rear end of the bed frame in the transverse direction. Legs 7 support the horizontal side members and the horizontal front and rear end members. This second embodiment is different from the first embodiment in that no intermediate cutoff portion is provided in any of the horizontal side members 4, and the horizontal rear end member 6 is mounted to the rear legs of the bed frame 1 at locations near their lower ends. The mount position of the horizontal rear end member 6 with respect to the rear legs 7 must be selected to provide not only a level surface for a base frame 41 of the moving/lifting apparatus 3, described later in more detail, allowing the same to pass under the horizontal rear end member 6, but also an upper space to permit vertical movement of the support arms 39. Accordingly, the height of the mount position of the horizontal rear end member 6 is determined to be lower than the height of the mount position of the horizontal front end member 5. Rear ends of the horizontal side members 4 are connected to upper ends of vertically standing posts 61, and lower ends of the posts 61 are fixed to the horizontal rear end member 6.

At the same level as the height of the mount position of the horizontal rear member 6 with respect to the legs 7, horizontal base members 89 extending between the front and rear ends of the bed frame in the longitudinal direction may be attached to the legs 7 for reinforcing rigidity of the bed frame 1. By attaching casters 90 to respective lower ends of the legs 7, the bed frame can move easily.

The guide frame 38 is mounted onto the base frame 41. The base frame 41 comprises a pair of elongate members extending longitudinally toward the rear end of the bed with a space in the transverse direction therebetween and having front wheels 49 attached to their front ends. The base frame 41 is fixed to the underside of a mount stand 42 at a location near the front end of the bed. Rear wheels 50 are attached to both sides of the mount stand 42 at its rear end and can move along guide rails 43 provided on the floor so as to extend in the longitudinal direction under the bed. The guide frame 38 is fixed to the mount stand 42 at a location near its front end and is extended upward vertically therefrom. The guide frame 38 has a structure having a channel-like shape in cross-section, i.e., comprising a front panel and both side panels each vertically standing with a rear side left open. A shaft 44 is provided within the guide frame 38 at an intermediate position to extend transversely, and a wire rope reel-up drum 45 is mounted on the shaft 44.

The lift frame 40 is provided adjacent outer surfaces of the guide frame 38 in surrounding relation. The lift frame 40 comprises a support arm mount plate 46 extending in the transverse direction while projecting from the guide frame 38 toward both sides, and a pair of roller mount plate 47 having one end fixed to the support arm mount place 46 and extending from the plates 46 toward the front side of the bed in the longitudinal direction. More specifically, the support arm mount plate 46 is positioned along an outer surface of the front panel of the guide frame 38 and is further extended outwardly and upwardly therefrom toward both sides. Base portions of the support arms 39 are fixed to upper ends of the outwardly raised extensions of the support arm mount plate 46. Each of the roller mount plates 47 has two rollers 48 mounted to an inner surface near its rear end and spaced from each other in the vertical direction. The rollers 48 have grooves in outer peripheral surfaces so that the lift frame 40 is vertically movable with the grooves engaging rear edges of the guide frame 38. The rear edges of the guide frame 38 serve to guide the rollers 48. Other rollers 48 may be mounted to the inner surface of each of the roller mount plates 47 near its front end. In this case, the roller 48 engages front edges of the guide frame 38.

Fixed to a rear portion of the mount stand 42 is a motor housing 51 in which two motors 52,53 are housed. The lower motor 53 is operatively coupled through a chain 54 to the wire rope reel-up drum 45 fixed on the shaft 44 thereby rotating the shaft 44. The wire rope reel-up drum 45 and the rear portion of the roller mount plate 47 is operatively coupled by a wire rope 56 which is led to pass around a pulley 57 attached to the upper end of the guide frame 38. When the shaft 44 is rotated in one direction, the wire rope 56 is reeled up over the wire rope reel-up drum 45 whereupon the lift frame 40 is moved upwardly while the rollers 48 are guided by the guide frame 38. When the shaft 44 is rotated in the opposite direction, the lift frame 40 is moved downwardly to rest on the mount stand 42.

The support arms 39 are extended in the longitudinal direction toward the rear side of the bed parallel to the outer side members 16 of the separable frame. A pair of vertically standing posts 58 spaced from each other in the longitudinal direction are fixed to each of the support arms 39 near its front end, and pawls 59 are attached to the respective tops of the posts 58 so as to upwardly project therefrom along their outer edges. The pawls 59 are each received between a pair of receiving metallic parts 60 in the form of vertically extending pieces attached to an outer surface of the rear portion, i.e., the seat portion of the outer side member 16 of the separable frame 2. Thus, the separable frame 2 is supported by the support arms 39 such that lower surfaces of the outer side members 16 of the separable frame 2 are rested on the upper ends of the posts 58, and the pawls 59 are received by the receiving metallic parts 60.

Figure 15:
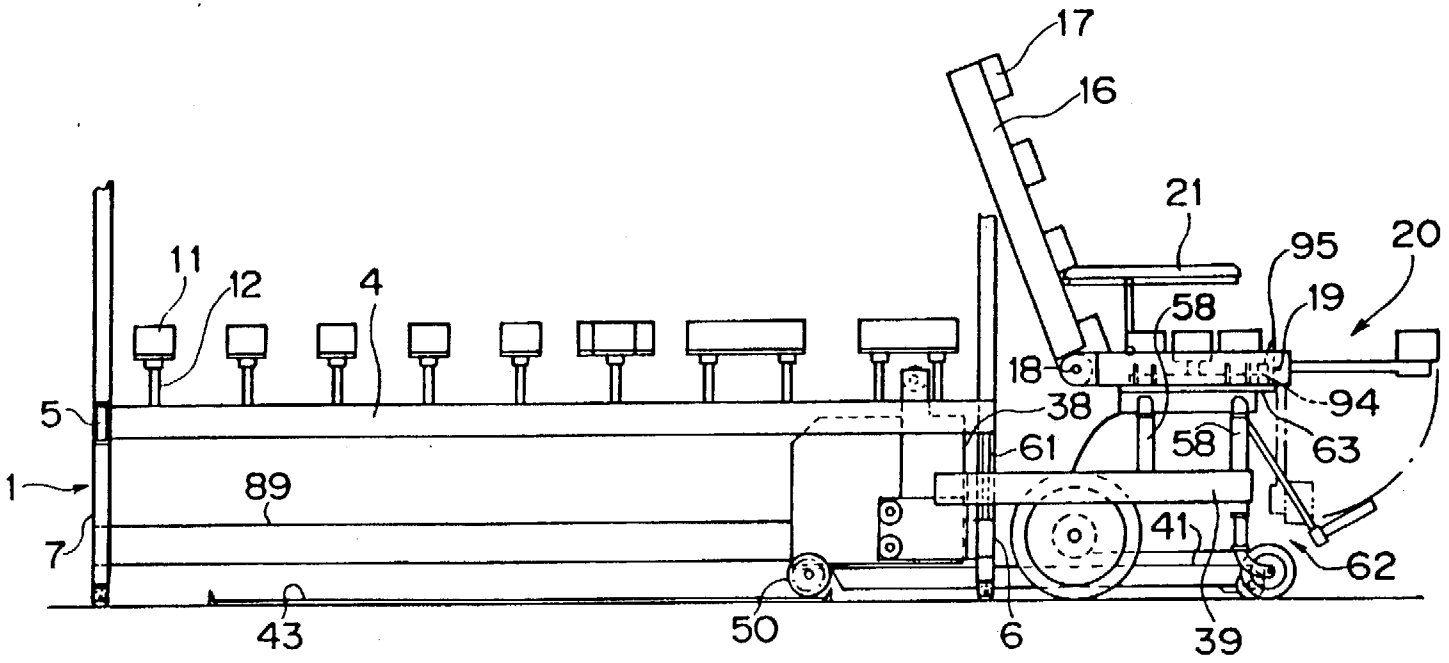
FIG. 15 is a side view illustrating a state in which a separable bed frame is moved by the moving/lifting apparatus according to the second embodiment onto a wheelchair stand positioned rearwardly of the bed.

As the lift frame 40 is lifted up, the support arms 39 are raised, and hence the separable frame 2 supported by the supports arms 39 is also raised. When the separable frame 2 is raised to a level higher than the upper surfaces of the comb teeth cushions 11 on the horizontal side members 4, the moving/lifting apparatus 3 is then moved toward the rear side of the bed. The moving/lifting apparatus 3 can move rearwardly until the position where the front surface of the guide frame 38 comes into contact with the horizontal rear end member 6. At this time, as shown in FIG. 15, the portion of the base frame 41 which is located in front of the mount position to the support arm mount plate 46 passes under the horizontal rear end member 6 to project outwardly of the bed rear end. Likewise, the portions of the support arms 39 which are located in front of the mount positions to the support arm plate 46 are projected outward from the bed rear end.

Prior to moving the separable frame 2 outward from the bed frame, associated equipment, such as a wheelchair stand, a toilet stool and a bathtub are installed beforehand in predetermined positions away from the bed frame depending on the purposes of use.

Each of the associated equipment has a receiving seat on which the separable frame 2 can be rested in a locked manner. After the separable frame 2 has been lowered and laid on the receiving seat, the support arms are disengaged from the separable frame 2.

Further, a comb teeth cushion 66 arranged to in match with the gap between the two adjacent comb teeth cushions on the separable frame can be provided on the receiving seat. For a wheelchair, particularly, the provision of the comb teeth cushion 66 is effective to increase stability in engagement between the receiving seat and the separable frame, and hence, improve comfort.

The associated equipment for receiving the separable frame according to the first embodiment is required to have a space below the receiving seat large enough to allow no horizontal movement of the support arms in the longitudinal direction thereof, but also vertical movement of the support arms for engagement with or disengagement from the separable frame 2.

Boss receiving holes may be formed in the lower surfaces of the outer side members 16 of the separable frame according to the first embodiment, and upwardly projected bosses adapted for fitting to the boss receiving holes may be provided at corresponding positions on the receiving seat. With this arrangement, the engagement between the separable frame and the receiving seat is stabilized.

By attaching wheels to the bottom of the associated equipment, the associated equipment can easily move. In addition, though not shown, a known wireless remote control device may be installed on the associated equipment. This enables the targeted associated equipment to be moved to a predetermined position without any attendants while the patient is lying thereon.

As one of the applications of the bed for the sick or wounded patient according to the present invention, FIG. 15 shows one exemplified wheelchair stand on which the separable frame is rested for combined use with a wheelchair. A wheelchair stand 62 has mainly a receiving seat 63 and front and rear wheels 64,65 mounted below the receiving seat 63. The receiving seat 63 includes a comb teeth cushion 66 extending in the transverse direction at the midpoint thereon. When the separable frame 2 that has moved outward from the bed frame is lowered, the rear portion of the separable frame 2 is rested on the receiving seat 63. The comb teeth cushion 66 on the receiving seat 63 is fitted to the gap between the two adjacent comb teeth cushions 17 on the separable frame. In the condition where the rear porion, i.e., the seat portion of the separable frame is rested on the receiving seat 63 in this way, the upper surfaces of the comb teeth cushions 17 and the upper surface of the comb teeth cushion 66 lie in the same plane.

Figure 17:
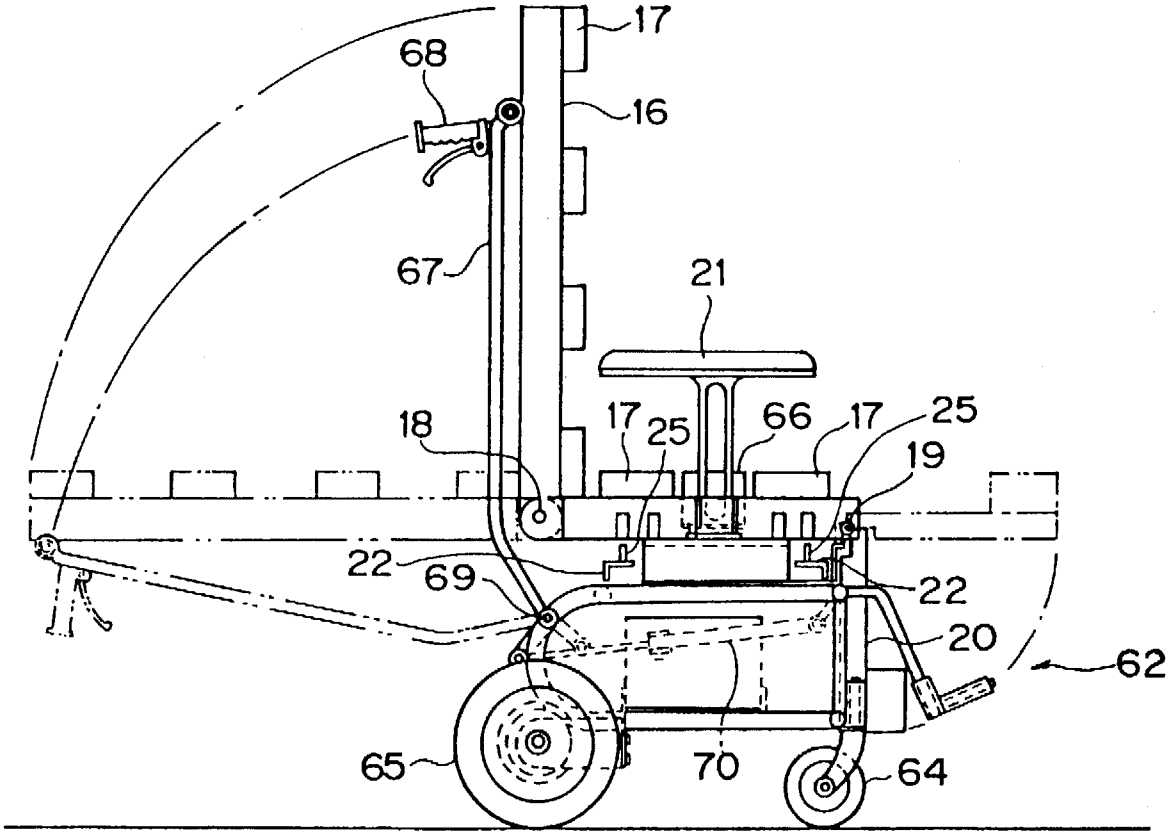
FIG. 17 is a side view of one example of the wheelchair.

FIG. 17 shows a condition where the support arms 22 in the first embodiment are further lowered to such an extent that the bosses 25 on the support arms are completely disengaged from the boss receiving holes formed in the separable frame.

Figure 16A:
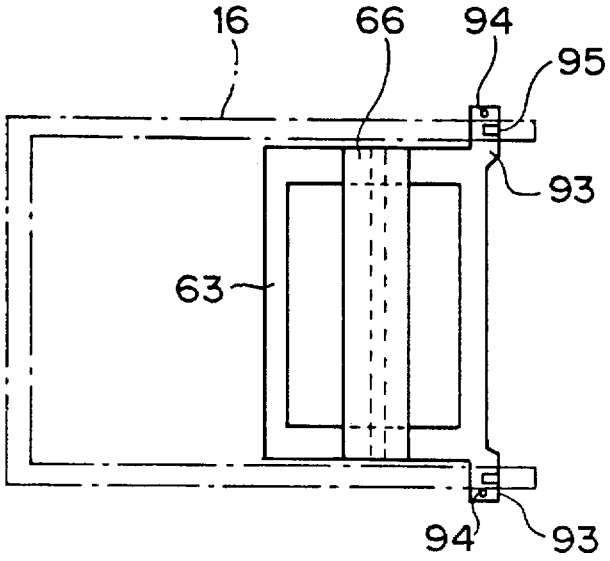
FIG. 16(A) is a plan view of the receiving seat.
Figure 16B:
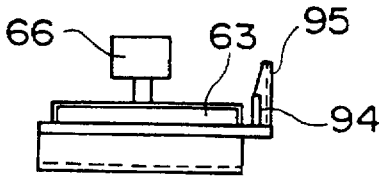
FIG. 16(B) is a side view of the receiver.
Figure 16C:
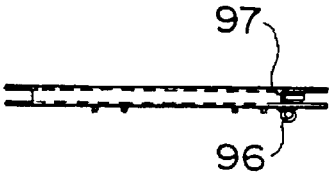
FIG. 16(C) is a plan view of part of the separable frame.

FIG. 15 shows a condition where the separable frame 2 in the second embodiment is moved outwardly from and rearward from the bed frame to a position just above the wheelchair stand and then lowered to rest on the receiving seat 63 of the wheelchair. In this case, at least the portion of the receiving seat 63 which is located rearward from the position corresponding to the front posts 58 on the support arms 39 under the rested condition must be designed such that both side edges of the receiving seat 63 are located inward from the front posts 58 to avoid interference with the front posts. FIG. 16(A) is a plan view showing the receiving seat 63 of the wheelchair stand suitable for the separable frame of the second embodiment. The receiving seat 63 is provided in front of the position corresponding to the front posts 58 under the rested condition with extensions 93 extending transversely from both of the sides. Upper surfaces of the extensions 93 are brought into contact with the lower surfaces of the outer side members 16 of the separable frame 2 when the separable frame 2 is rested on the receiving seat 63.

The extensions 93 each have an upstanding boss 94 provided near its outer side end, and an index 95 provided inward from the boss 94. The outside members 16 of the separable frame 2 each have a hollow boss receiver 96 provided on its outer side surface at the position corresponding to the boss 94 and an index receiver 97 formed as an elongate hole in the outer side member 16 at the position corresponding to the index 95. The index 95 is inclined toward its upper end so that it is easily received by the index receiver 97 and guided to a proper position.

Furthermore, the wheelchair stand 62 may be provided with a handle operatively coupled to the front wheels 64, a brake operatively coupled to the rear wheels 65 and so on. In addition, if a motor operatively coupled to the rear wheels 65 is mounted, the wheelchair can be self-propelled. The wheelchair stand shown in FIG. 17 includes a lever 67 serving as a handle which is provided on the back side so that an attendant can steer the wheelchair from the back side while pushing it. A handle grip 68 is attached to a distal end of the lever 67 and is held in engagement with a back surface of the front portion of the separable frame. The lever 67 is rotatable about a shaft 69 so that the front portion of the separable frame can be raised and lowered by grasping the grip handle 68. The lever 67 may be operatively coupled to a fluid pressure cylinder 70, such as a hydraulic cylinder, to produce assistive power for raising the front portion of the separable frame.

Figure 18:
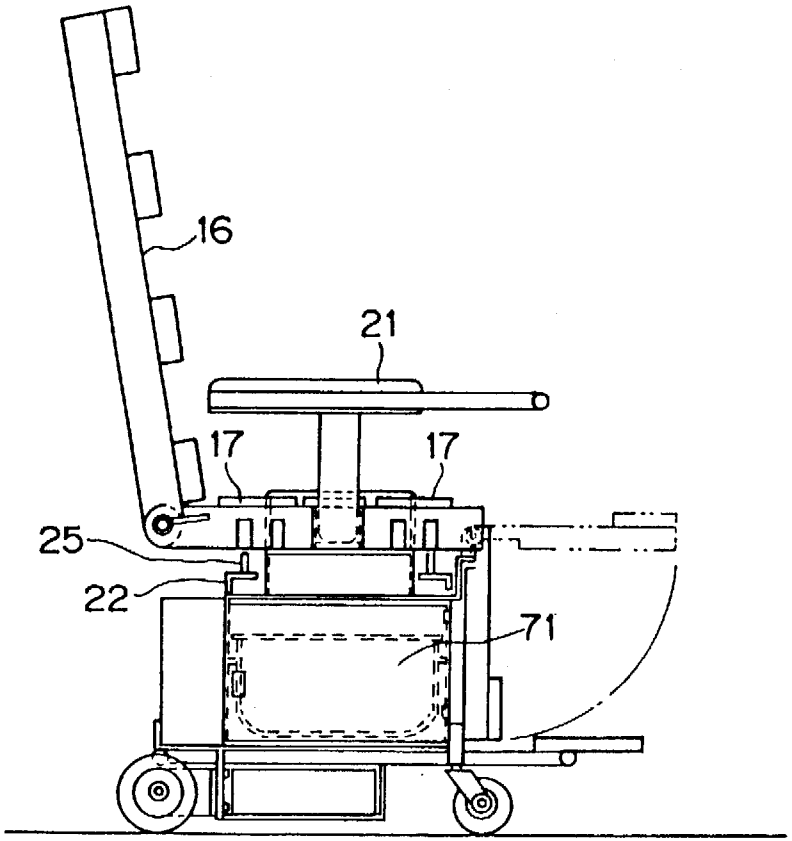
FIG. 18 is a side view illustrating a state that the separable frame is used in combination with a toilet stool.

FIG. 18 shows a manner of using the separable frame 2 for defecation. As with the case of the wheelchair stand 62, the separable frame 2 is moved to a location above a movable toilet stool 71 which is installed beforehand in a predetermined position away from the bed frame. Taking into account the use for defecation, the two adjacent comb teeth cushions 17 in the rear portion of the separable frame corresponding to the seat portion on which the patient is to sit can be formed to have semicircular cutouts 72 in their side surfaces facing each other. When the separable frame 2 is moved outward from the bed frame and then stopped after resting on a receiving seat 63 of the toilet stool 71, the front portion of the separable frame 2 which constitutes the backrest portion is folded to rise up.

FIG. 18 shows a condition where the support arms 22 in the first embodiment are further lowered to such an extent that the bosses 25 on the support arms are completely disengaged from the boss receiving holes formed in the separable frame. However, when the separable frame is used in combination with a toilet stool, it is not necessarily disengaged from the support arms 22.

Figure 19:
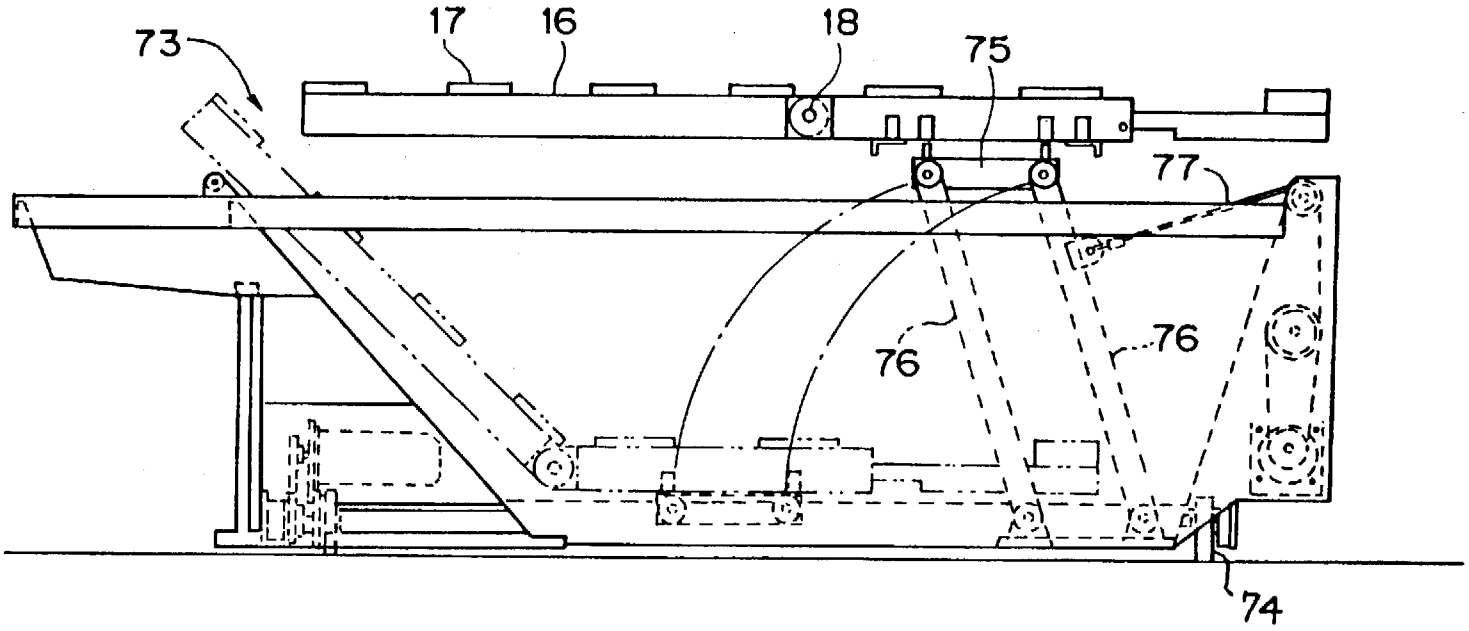
FIG. 19 is a side view illustrating a state that the separable frame is used in combination with a bathtub.

FIG. 19 shows one example of a bathtub when the patient lying on the separable frame takes a bath. The separable frame 2 of the present invention is employed in combination with an adaptable bathtub 73. The bathtub 73 has wheels 74, and one of the axles for the wheels 74 is operatively coupled to a power source so that the bathtub 73 is self-propelled when the axle is driven by the power source. A receiving seat 75 for receiving the separable frame is provided in a rear portion of the bathtub 73. A pair of arms 76 extending parallel to each other have upper ends pivotally attached to front and rear ends of the receiving seat 75, respectively, and lower ends pivotally attached to the inner bottom of the bathtub. The pair of arms 76 are attached such that the rear arm is shifted transversely with respect to the front end arm. With this arrangement, the arms 76 can be prevented from interfering with each other when rotated toward the inner bottom of the bathtub 73. When the arms 76 are fully rotated forward, the receiving seat 75 is engaged in the inner bottom of the bathtub 73. One of the arms is operatively coupled to a power source through a rope 77 for rotating the arms 76.

When using the moving/lifting apparatus of the first embodiment, it is required to secure a space between a lower surface of the receiving seat 75 and an upper edge of the bathtub 73 large enough to allow not only horizontal movement of the support arms 22 in the longitudinal direction thereof, but also vertical movement of the support arms 22 for engagement with or disengagement from the separable frame 2.

Figure 4:
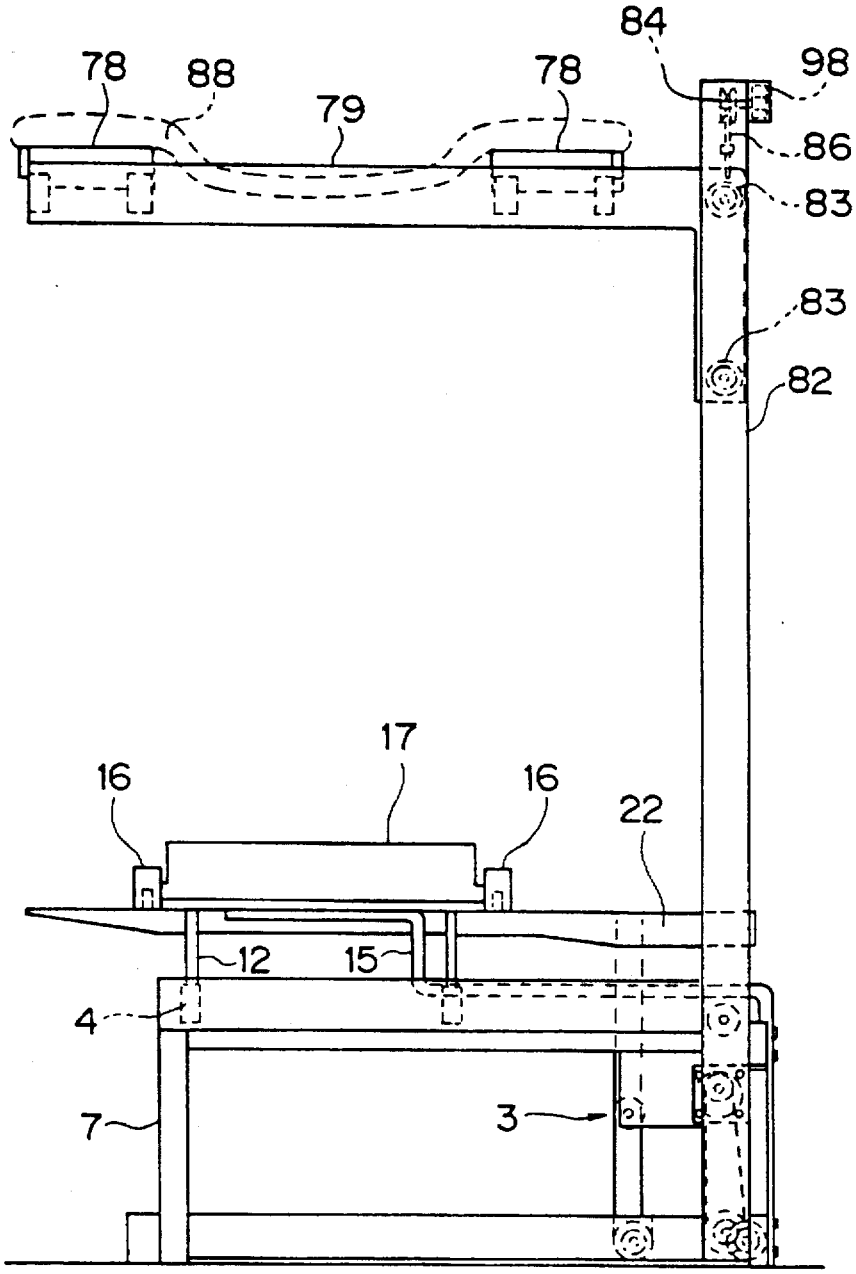
FIG. 4 is a front view of the bed for the sick or wounded patient in the state of FIG. 3.
Figure 5:
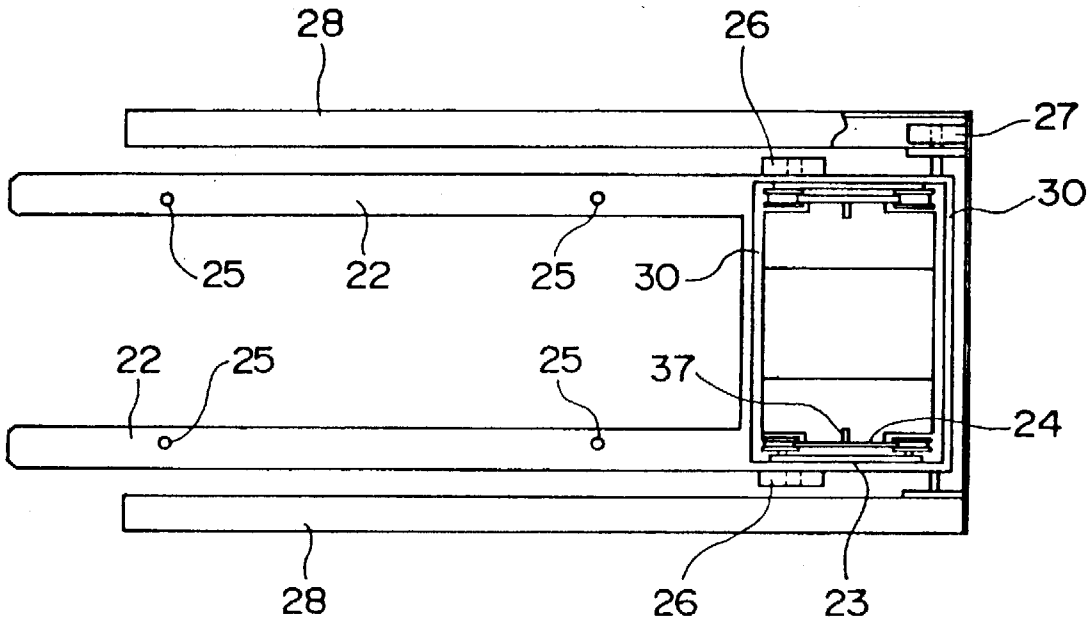
FIG. 5 is a plan view of a moving/lifting apparatus according to the first embodiment.
Figure 6:
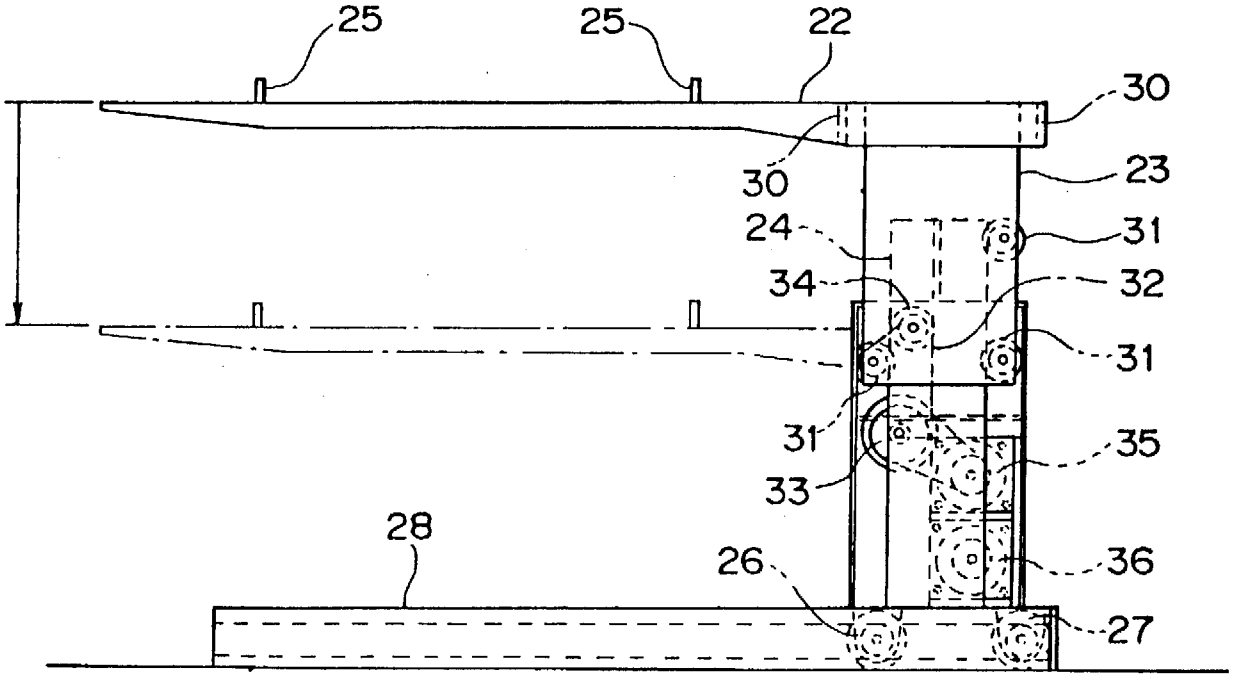
FIG. 6 is a side view of the moving/lifting apparatus as shown in FIG. 5.
Figure 7:
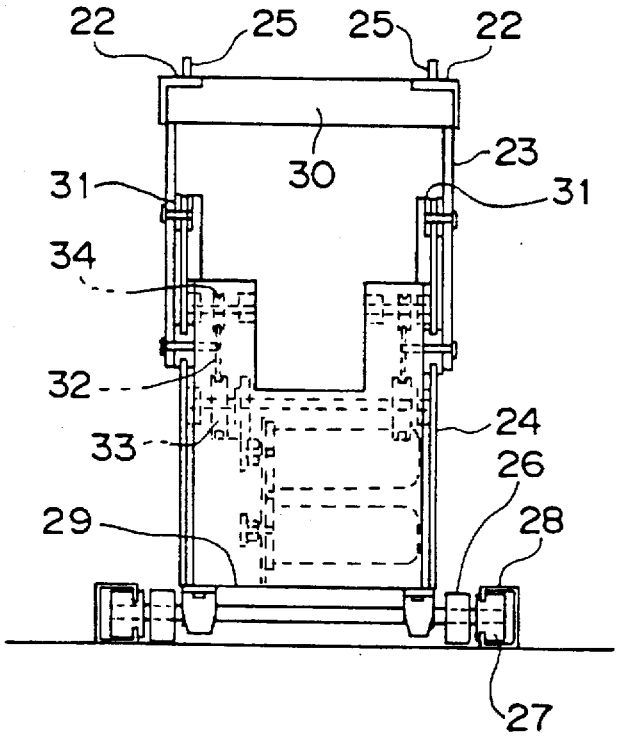
FIG. 7 is a front view of the moving/lifting apparatus shown in FIG. 6.
Figure 8:
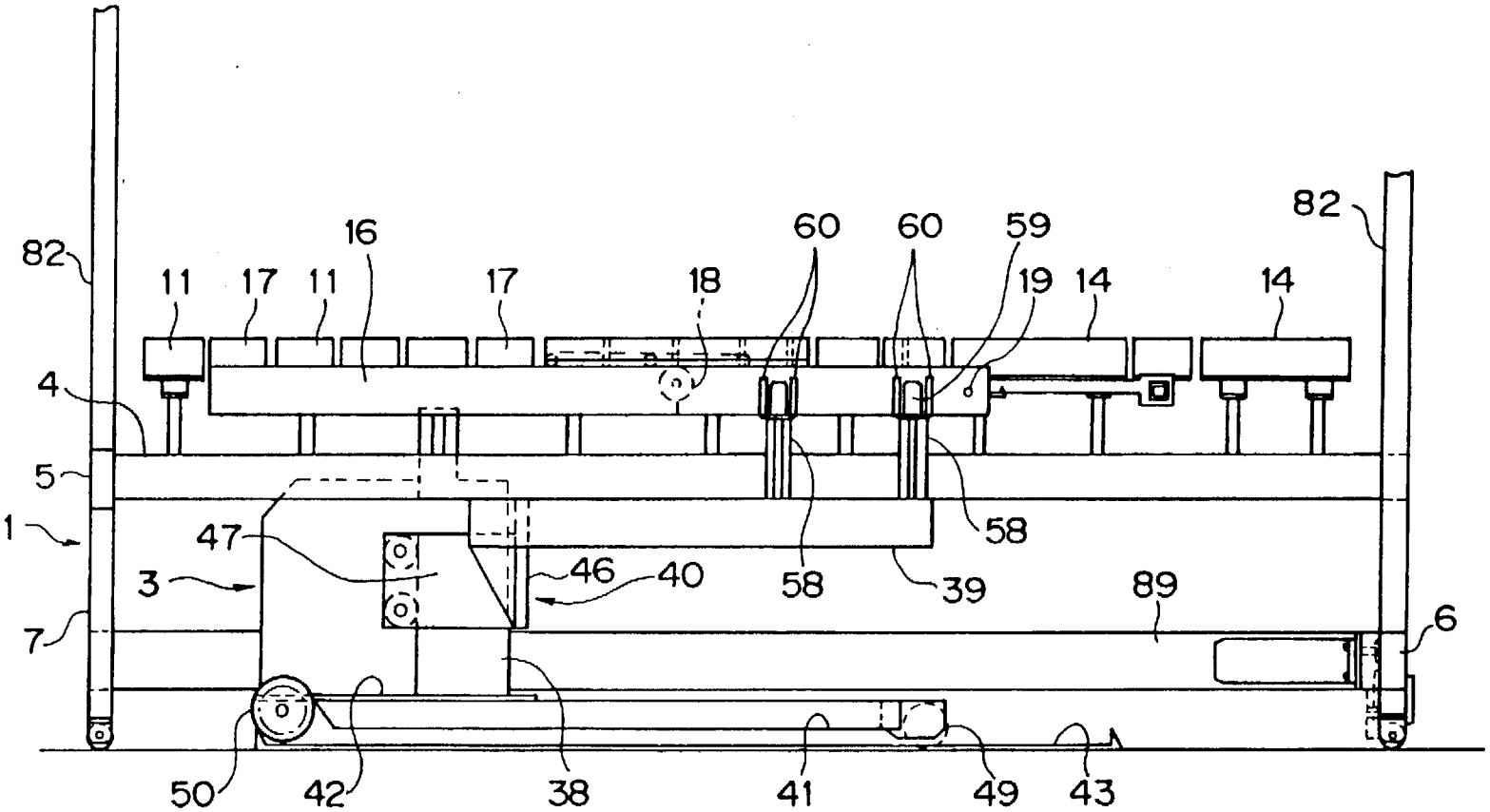
FIG. 8 is a side view of a bed for the sick or wounded patient according to a second embodiment of the present invention.
Figure 9:
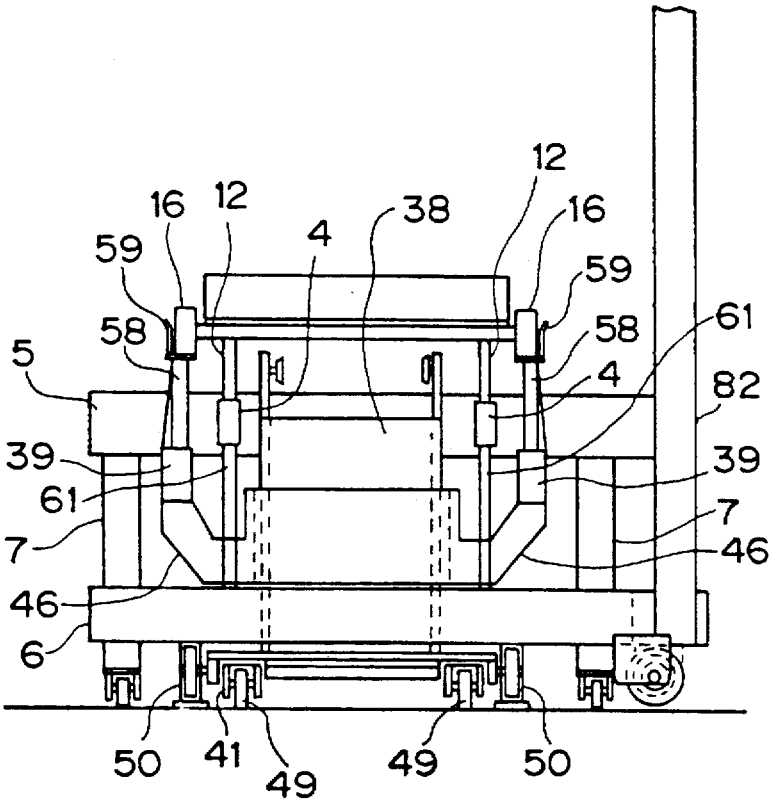
FIG. 9 is a front view of the bed shown in FIG. 6 as viewed from the front.
Figure 10:
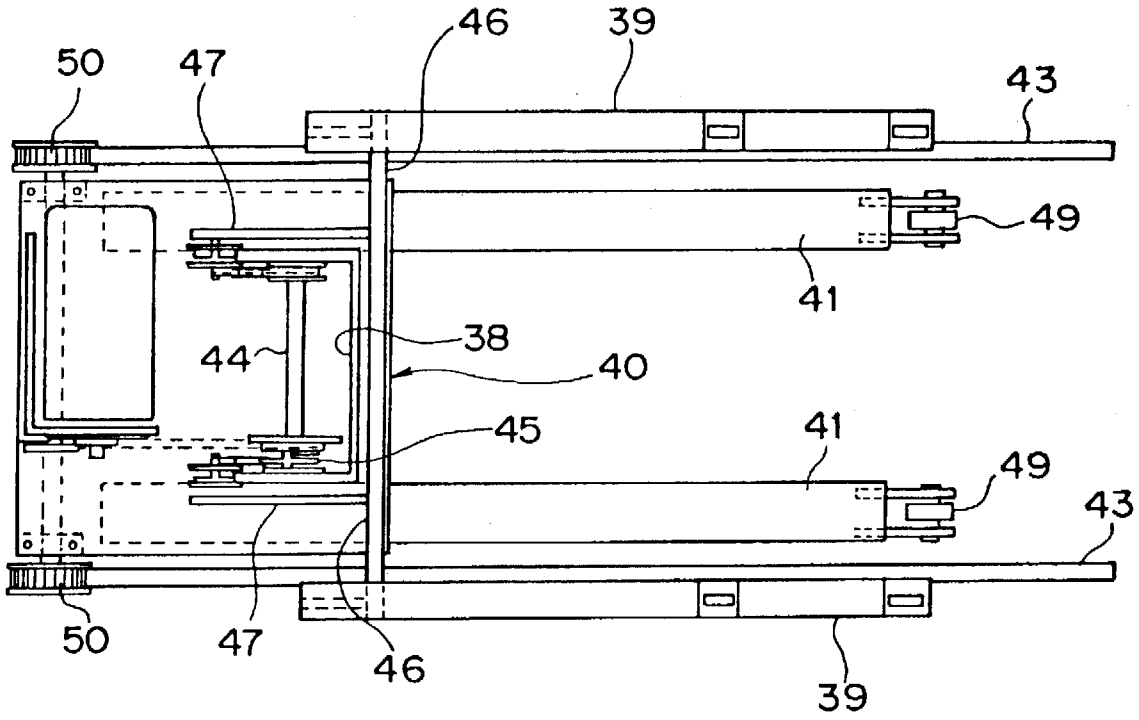
FIG. 10 is a plan view of a moving/lifting apparatus according to the second embodiment.
Figure 11:
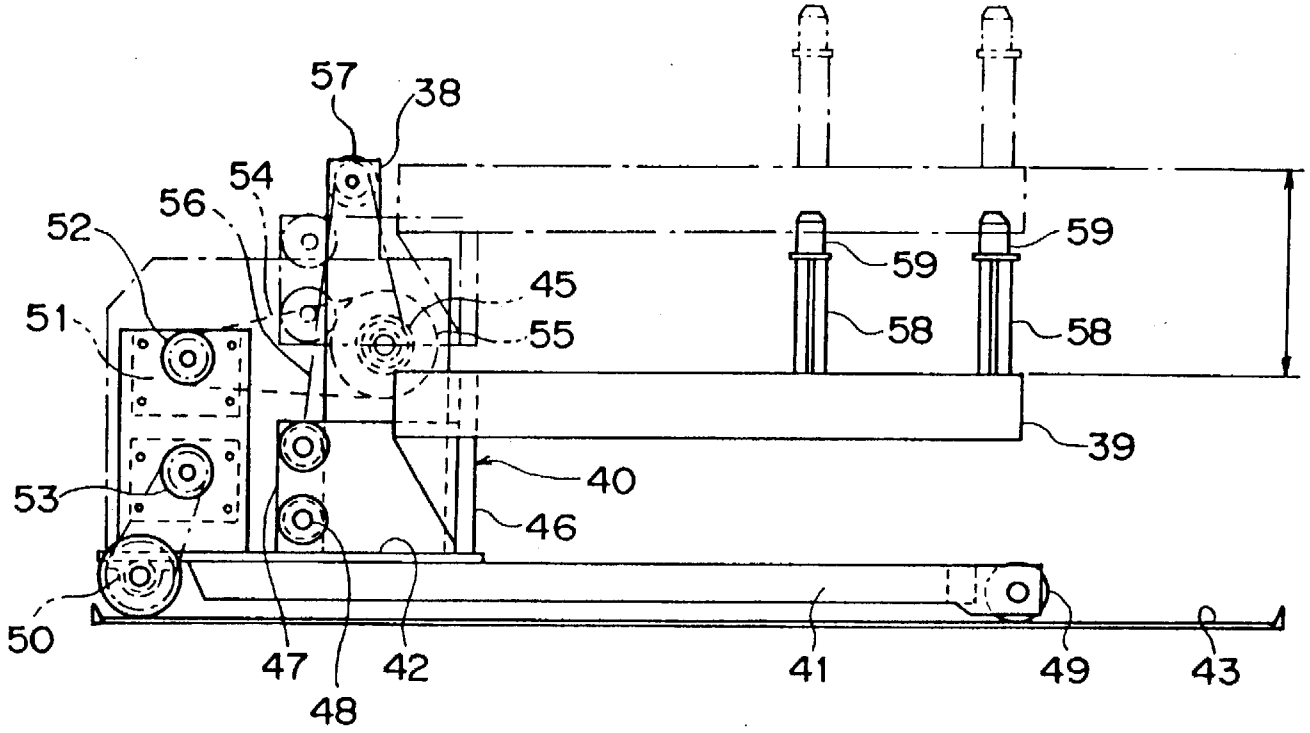
FIG. 11 is a side view of the moving/lifting apparatus shown in FIG. 10.
Figure 12:
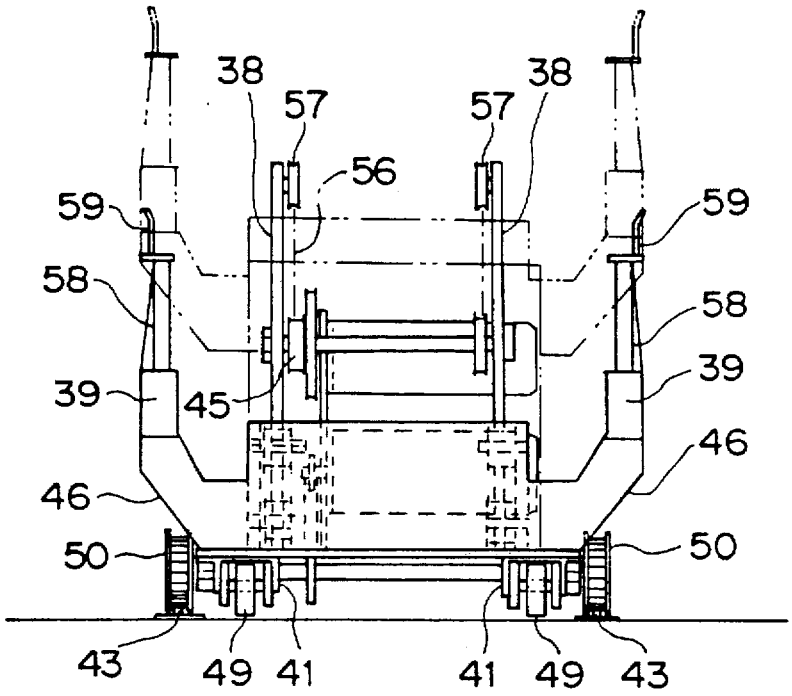
FIG. 12 is a side view of the moving/lifting apparatus shown in FIG. 10.
Figure 13:
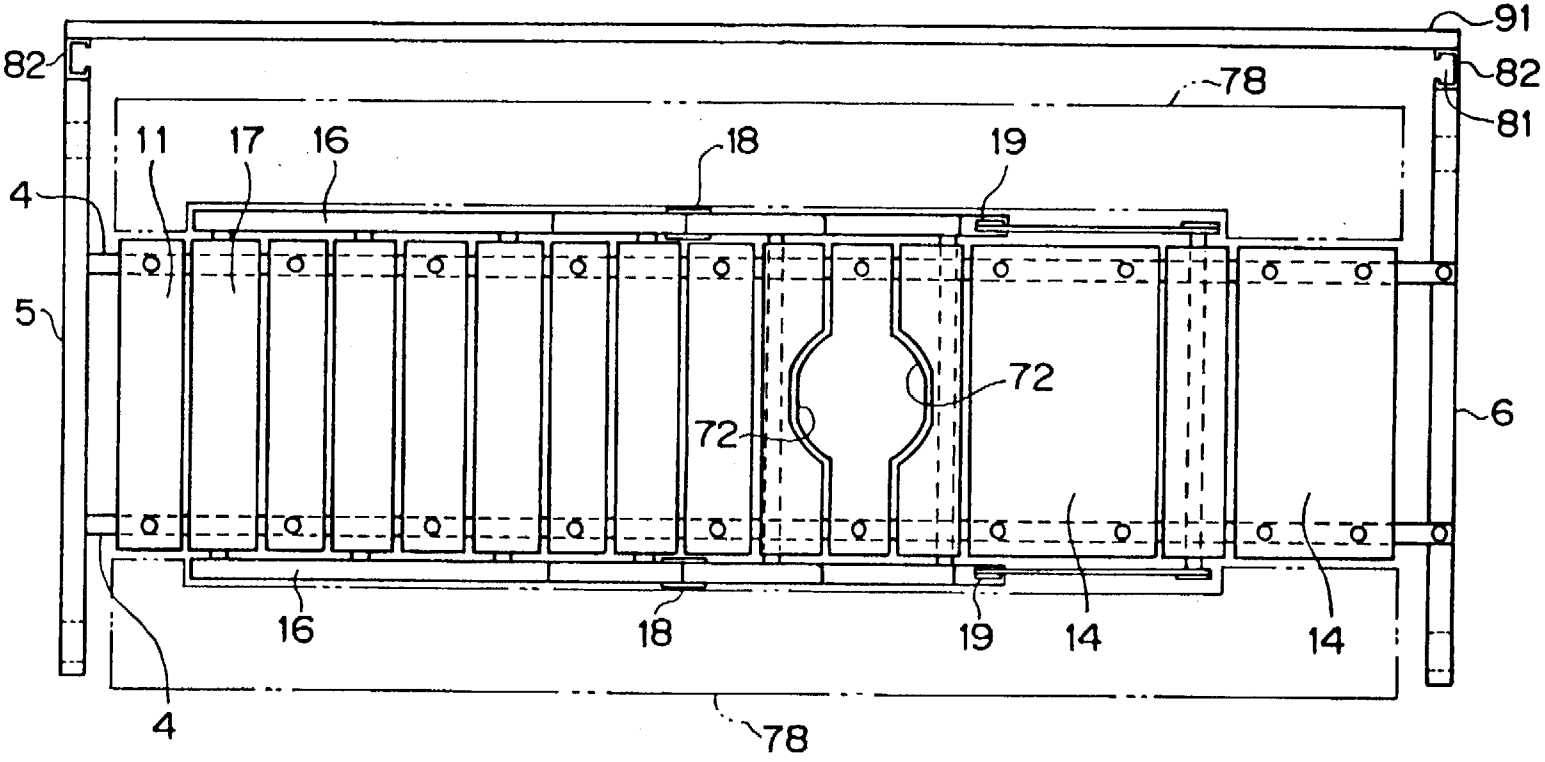
FIG. 13 is a plan view of a bed frame.
Figure 14:
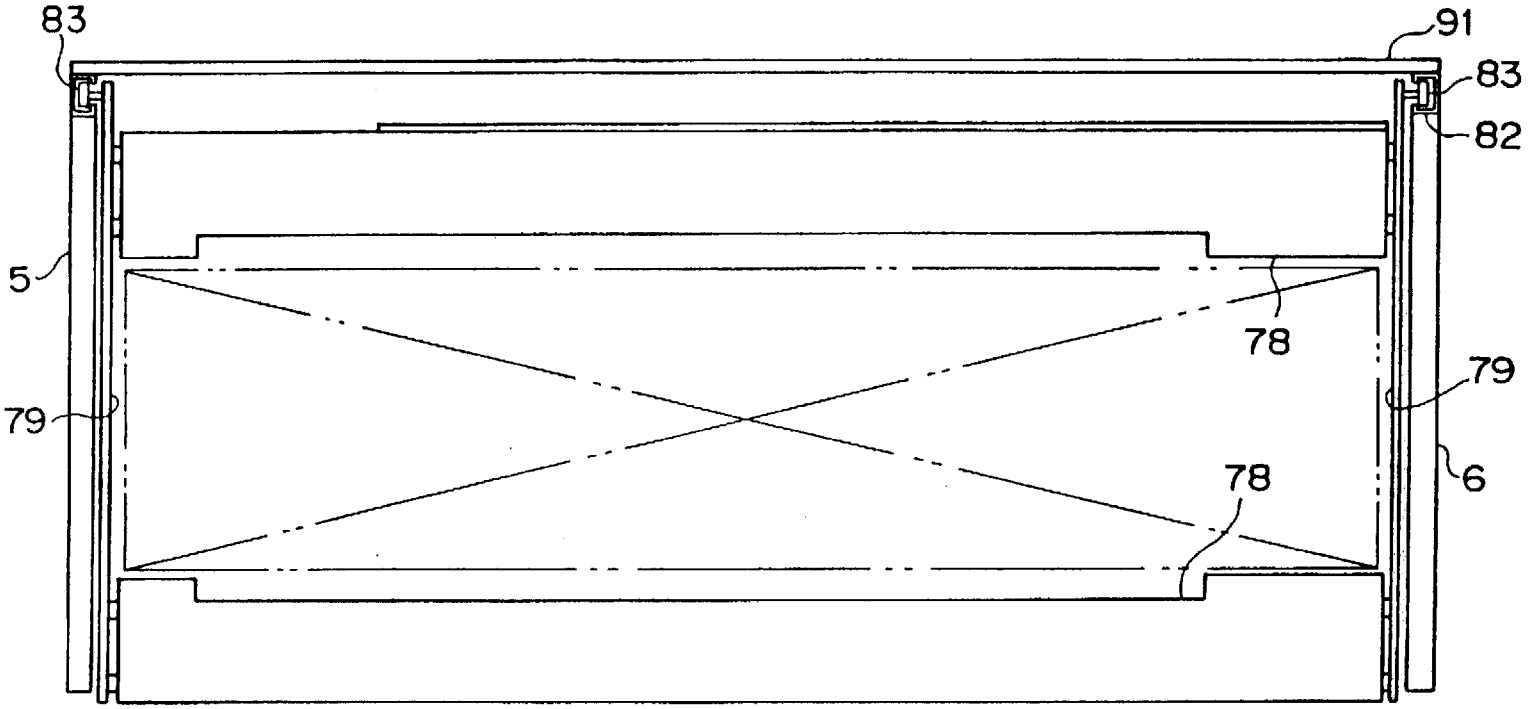
FIG. 14 is a plan view of an auxiliary cushion and an auxiliary cushion lift.

As shown in FIGS. 4, 14 and others, auxiliary cushions 78 are provided in the form of elongate members extending from the front end to the rear end of the bed in the longitudinal directions near both the side ends thereof, and able to move vertically by an auxiliary cushion lift. Front and rear ends of the auxiliary cushions 78 are attached respectively to a pair of bars 79 extending horizontally in the transverse direction near opposite ends of the bars 79. One end of each of the bars 79 forms a sliding portion 80 bent at a right angle from the bar and extending downwardly. A pair of poles 82 each having a groove 81 formed therein can be attached to the front and rear ends of the bed frame 1 at one side to stand vertically therefrom, and the sliding portion 80 is engaged in the groove 81 so that it is slidable vertically along the groove. Specifically, the grooves 81 are formed in respective surfaces of the front and rear poles 82 facing each other, and rollers 83 attached to the sliding portions 80 of the bars 79 are movable vertically in the grooves 81. A rope 86 is extended from a reel-up drum 85 mounted in a lower portion over a sprocket 84 attached to an upper end of the pole 82 and then secured to the sliding portion 80 of the bar 79. The reel-up drum 85 is operatively coupled to a power source. When the reel-up drum 85 is rotated, the rope 86 is reeled up and out and around the reel-up drum 85 through the sprocket 84 whereupon the bar 79 can be moved up and down along the pole 82.

The auxiliary cushion 78 is provided along its outer side edge with a rail 87 (see FIG. 3), and a plurality of rollers each having a gripper 92 are movable horizontally in the rail 87. Bedclothes such as a quilt 88 can be held at side edges by the grippers 92 so that the quilt 88 is movable not only in the horizontal direction along the rails 87 but also in the vertical direction by lifting and lowering the bar 79. When the patient employs any associated equipment, the quilt 88 is required to be raised beforehand.

Between the pair of front and rear poles 82, a pole-to-pole horizontal member 91 is provided for connecting upper ends of the poles to each other in the longitudinal direction. The pole-to-pole horizontal member 91 also has a groove formed therein. A drum 98 is mounted on the same end of the horizontal member 91 as the end at which the reel-up drum 85 is mounted, and a pulley 99 is attached to the pole on the opposite side. A rope 100 secured at its one end to the sliding portion of the bar engaging the opposite pole is extended over the pulley 99 and through the groove in the pole-to-pole horizontal member 91, and then secured at the other end to the drum 98. Thus, as the bar on the same side as the reel-up drum 85 is moved vertically, the bar on the opposite side is also moved vertically at the same time.

The operation of the present invention is summarized as follows. When the support arm attached to the moving/lifting apparatus and supporting the separable frame is moved vertically, the separable frame is also moved vertically while the patient is lying thereon. Further, the separable frame is movable in the transverse or longitudinal direction of the bed to a location above the associated equipment, such as a wheelchair stand, a toilet stool or a bathtub, which is installed in a predetermined position beforehand away from the bed frame.

When the support arm is lowered, the separable frame is lowered onto the associated equipment and rested on the receiving seat of the associated equipment. When the support arm is further lowered, it is disengaged from the separable frame.

On the wheelchair or the toilet stool, the front portion of the separable frame is raised so that the separable frame becomes a chair having a backrest. When the separable frame is lowered into the bathtub, its front portion is automatically raised following the shape of the bathtub. When combined with the wheelchair stand, the separable frame serves as a hand-held or self-propelled wheelchair.

The auxiliary cushion lift raises the bars connected to the auxiliary cushions prior to moving the separable frame whereupon a quilt held at its side edges by the auxiliary cushions is also raised to create a space for movement of the separable frame therethrough.

The separable frame once moved outward from the bed frame and disengaged from the support arm can be supported by the support arm, raised, moved horizontally to a location above the bed frame, and then lowered to the original position by carrying out the above-mentioned steps in a reverse sequence starting from the predetermined position away from the bed frame.

The moving/lifting apparatus, the auxiliary cushion lift, etc., can be driven and operated by the patient alone by arranging switches electrically connected to respective driving units at such positions as accessible by the patient on the bed frame, the separable frame, the receiving seat and so on.

As described hereinabove, according to the present invention, the patient can move away from the bed to go around, go to a stool or take a bath by his or her own will with the minimum aid of other persons.

With the structure using the comb teeth cushions, the bed is highly air-permeable and can prevent the patient from suffering bedsores and can be kept in good sanitary condition.

By moving the separable frame vertically while the patient is lying thereon such that the comb teeth cushions of the separable frame and the comb teeth cushions of the bed frame have different heights from each other, sheets of those comb teeth cushions can be exchanged by new ones. Further, the comb teeth cushions themselves can be exchanged by ones suitable for the patient condition. When taking a bath, particularly, the comb teeth cushions of the separable frame can be exchanged by water-proof ones.

Since side edges of a quilt or the like are held by the auxiliary cushions in a slidable manner, the quilt or the like can be prevented from slipping off or falling down, and the patient can easily adjust the position of the quilt.

The quilt or the like can be moved vertically by the auxiliary cushion lift enabling the separable frame to be moved away from the bed.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A sick or wounded patient bed including a bed frame which includes horizontal side members extending between front and rear ends of said bed in the longitudinal direction, with a plurality of comb teeth cushions spaced from each other extending in the transverse direction from said horizontal side members, horizontal end members extending in the transverse direction and joined to both ends of said horizontal side members at front and rear ends of said bed, and legs supporting said horizontal side members and said horizontal end members, said bed comprising:

a separable frame which has a pair of outer side members extending in the longitudinal direction outside both side ends of said comb teeth cushions on said horizontal side members, and said comb teeth cushions extending between said pair of outer side members in the transverse direction, said cushions positioned to fill gaps between adjacent comb teeth cushions on said horizontal side members to enable said comb teeth cushions of said separable frame to pass through the gaps between said comb teeth cushions vertically and to move away from said bed frame to cooperate with associated equipment, such as a wheelchair stand, a toilet stool, a bathtub, or the like placed outside of the bed;

a moving/lifting apparatus including support arms, a guide frame and a lift frame, said support arms fixedly attached at its base portion to an upper portion of said lift frame, extending horizontally from the fixed base portion to support said separable frame detachably and move it on the floor under said bed parallel to said support arms guiding said support arms to allow vertical movement of said support arms; and said support arms adapted to raise said separable frame for movement outwardly of said bed, adapted to lower said separable frame onto said associated equipment placed outside of the bed, and adapted to return thus-moved separable frame to the original position on said bed frame again.

2. The sick or wounded patient bed according to claim 1 wherein said moving/lifting apparatus is placed midway in the longitudinal direction of the bed to make the bed movable transversely of said bed and under a condition where said separable frame is held on said bed frame and is placed close to one side of the bed frame with two support arms extending parallel to each other in the transverse direction of said bed supporting said separable frame from below at a right angle.

3. The sick or wounded patient bed according to claim 2 wherein said guide frame of said moving/lifting apparatus has a pair of front wheels and a pair of rear wheels attached to its lower end and oriented in the transverse direction of said bed wherein a guide rail for guiding at least one of said wheels is provided under said bed to extend in the transverse direction, said moving/lifting apparatus movable along said guide rail.

4. The sick or wounded patient bed according to claim 3 wherein said pair of rear wheels is disposed outwardly from said pair of front wheels and said pair of rear wheels are guided by said guide rails.

5. The sick or wounded patient bed according to claim 2 wherein each of said support arms has upwardly projecting bosses formed on an upper surface of each of the support arms in positions intersecting said outside side members of said separable frame wherein said bosses are received by boss receiving holes formed in lower surfaces of said outer side members.

6. The sick or wounded patient bed according to claim 2 wherein at least one of said horizontal side members on the side where said guide frame of said moving/lifting apparatus is located is cut off midway to provide an intermediate cutoff portion wherein the cutoff portion of said horizontal side member is supported by an intermediate post extending vertically to the floor.

7. The sick or wounded patient bed according to claim 1 wherein said moving/lifting apparatus is movable in the longitudinal direction of said bed wherein when said separable frame is held on said bed frame, a lift frame is located near the front end of said bed frame and two support arms extend horizontally in the longitudinal direction of said bed parallel to each other with a space therebetween and further extend along said outer side members of said separable frame, while supporting said separable frame from below.

8. The sick or wounded patient bed according to claim 7 wherein a guide frame of said moving/lifting apparatus has a base frame comprising two horizontal members extending in the longitudinal direction of said bed parallel to each other, a pair of front wheels and a pair of rear wheels attached to distal ends of said horizontal members near the rear end of said bed and portions of said horizontal members near the front end of said bed, respectively, said wheels oriented in the longitudinal direction of said bed wherein a guide rail for guiding at least one of said wheels is provided under said bed to extend in the longitudinal direction, said moving/lifting apparatus movable along said guide rail.

9. The sick or wounded patient bed according to claim 8 wherein said pair of rear wheels are disposed outwardly from said pair of front wheels and said pair of rear wheels are guided by said guide rails.

10. The sick or wounded patient bed according to claim 7 wherein each of said support arms has two vertically standing posts provided on its base portion and an opposite portion near its distal end with a space therebetween in the longitudinal direction, a pawl is provided on an upper end of each of said posts to further extend upward from an outer side edge of said post, said pawl received between a pair of pawl receiving metallic parts provided to project vertically to and from each of said outer side members of said separable frame wherein said outer side members of said separable frame are rested on and supported by the upper ends of said posts.

11. The sick or wounded patient bed according to claim 7 wherein said horizontal end member at the rear end of said bed is attached to said legs near their lower ends at a level higher than said base frame and lower than said support arms.

12. The sick or wounded patient bed according to claim 1 wherein rollers are attached to said lift frame of said moving/lifting apparatus and, when said lift frame is moved vertically, outer peripheral surfaces of said rollers engage a vertical edge of said guide frame for guiding said rollers along the vertical edge.

13. The sick or wounded patient bed according to claim 12 wherein said rollers are attached to front and rear portions of said lift frame for engagement with front and rear vertical edges of said guide frame wherein at least one roller in the front portion is attached to a relatively low position on said lift frame and at least one roller on the rear portion is attached to a relatively high position on said lift frame wherein all of said rollers serve as support points for said support arms with respect to said guide frame.

14. The sick or wounded patient bed according to claim 12 wherein said rollers are grooved rollers each having a groove in its outer peripheral surface, said groove engaging the vertical edge of said guide frame.

15. The sick or wounded patient bed according to claim 1 wherein said moving/lifting apparatus includes a wire rope, said wire rope having one end secured to said lift frame and the other end coupled to a wire rope reel-up drum so that when said wire rope reel-up drum is rotated, said lift frame is moved vertically while being guided by said guide frame.

16. The sick or wounded patient bed according to claim 1 wherein said outer side members of said separable frame are each divided into front and rear portions at a middle point in the longitudinal direction wherein said front and rear portions are coupled to each other in a foldable manner about a pivot shaft provided at the middle point, said front portion raised to serve as a backrest portion, said rear portion supported by said support arms to serve as a seat portion.

17. The sick or wounded patient bed according to claim 16 wherein the rear portions of said outer side members of said separable frame are each divided midway to have a rear end portion which can be folded downwardly.

18. The sick or wounded patient bed according to claim 1 wherein said comb teeth cushions are detachably attached to said bed frame or said separable frame.

19. The sick or wounded patient bed according to claim 1 wherein said comb teeth cushions attached onto said horizontal side members of said bed frame are attached to the tops of posts vertically fixed onto said horizontal side members.

20. The sick or wounded patient bed according to claim 1 wherein the height of said comb teeth cushions of said separable frame is movable upwardly or downwardly with respect to said comb teeth cushions on said horizontal side members.

21. The sick or wounded patient bed according to claim 1 wherein said support arms are further lowered if said separable frame is held at a certain level above said associated equipment, then said support arms are disengaged from said separable frame.

* * * * *